United States Patent [19]

Alexander, Jr.

[11] 4,008,680

[45] Feb. 22, 1977

[54] PIVOTAL MOUNT ASSEMBLY FOR TROLLING MOTORS

[75] Inventor: Charles F. Alexander, Jr., Oshkosh, Wis.

[73] Assignee: Brunswick Corporation, Skokie, Ill.

[22] Filed: Sept. 4, 1975

[21] Appl. No.: 610,414

[52] U.S. Cl. ..... 115/18 E; 115/17; 115/41 R; 248/4

[51] Int. Cl.[2] ..... B63H 21/26

[58] Field of Search ..... 115/17, 18 R, 18 E, 115/41 R; 248/4

[56] References Cited

UNITED STATES PATENTS 3,870,258 3/1975 Shimanckas et al. ..... 248/4

*Primary Examiner*—Trygve M. Blix
*Assistant Examiner*—Sherman D. Basinger
*Attorney, Agent, or Firm*—Andrus, Sceales, Starke & Sawall

[57] ABSTRACT

A pivotal mount for a trolling motor includes a deck bracket having a housing arm pivotally mounted at one end. A gear mechanism within the arm has a fixed bevel gear on the pivot arm axis meshing with a bevel gear on a rotatable torque tube. A drive bevel gear is secured to the opposite end and meshes with a gear sector on a coupling head pivotally mounted in the outer end of the arm. The head includes a swivel support within which the trolling motor unit is rotatably mounted. The coupling head and motor unit are located between a depending propulsion position and transport position in response to the 180° swinging of the pivot arm. The torque tube is coupled to the bevel gears by sliding couplings and is coupled to a locking device for the arm and for the gear sector to lock them in the propulsion position and simultaneously release them for raising to the transport position.

11 Claims, 8 Drawing Figures

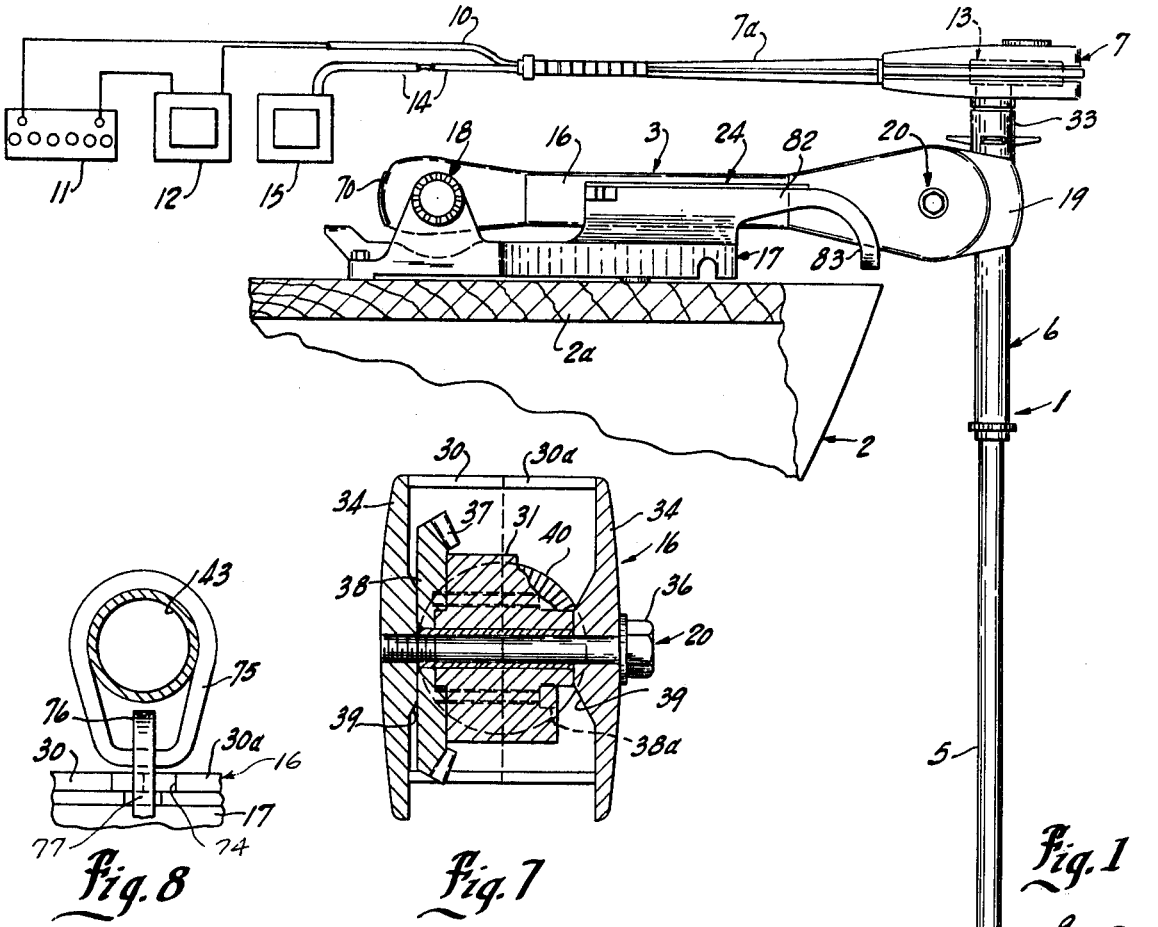
Fig. 1
Fig. 7
Fig. 8
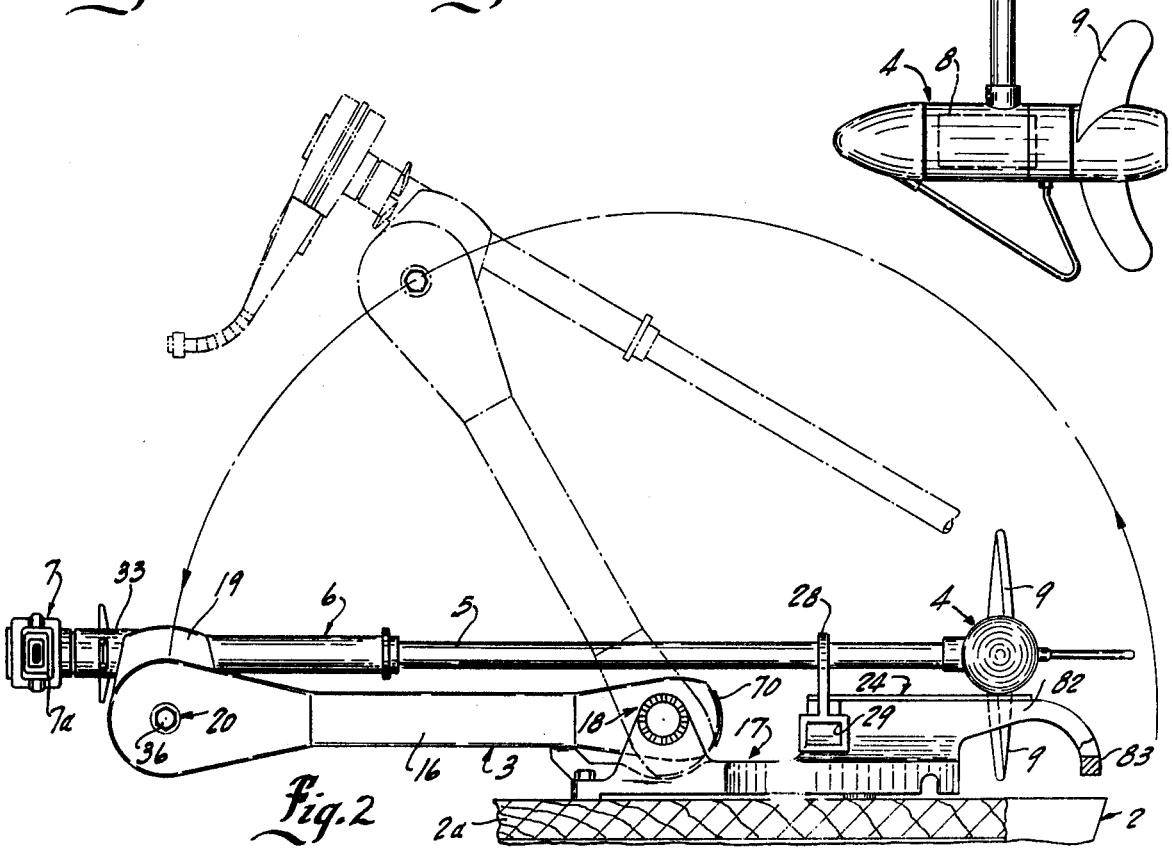
Fig. 2

PIVOTAL MOUNT ASSEMBLY FOR TROLLING MOTORS

BACKGROUND OF THE INVENTION

This invention relates to a trolling motor unit for propelling of watercraft particularly at low speeds.

In bass fishing and the like, a trolling motor unit is often employed to very slowly maneuver, position, and hold the watercraft or boat in proper positioning for casting. Generally, the trolling motor unit is mounted to a horizontal deck at the forward end of the watercraft. The mounting includes a pivotal mount assembly permitting the depending of the motor unit from the front of the boat for propulsion of the boat. Alternatively, the trolling motor unit will be raised from the propulsion position and placed in a transport position across the deck. A separate high-powered outboard motor or the like is employed for rapid propulsion of the boat to and from the fishing location or area.

The trolling motor unit will normally include a depending pipe-like support mounted in a swivel bracket. The pipe-like support terminates at the lower end in a lower unit within which a small electric motor is housed for direct driving of the propeller. The upper end of the support tube includes steering means for angular positioning of the lower unit for steering of the watercraft. The propeller speed is controlled by varying the energization of the electric motor. The steering and speed controls are normally switch controls located within the boat coupled by suitable lines and cables to the motor and to the support tube.

The pivotal mount assembly is preferably constructed such that in the transport position, the motor unit is located within the boat and does not protrude over the outer edge of the boat. Generally prior art mounting systems have employed various linkages which provide for positioning between the depending propulsion and a transport position in which the trolling motor unit is located lying on the supporting deck with the lower unit or propeller end of the motor unit lying inwardly of the outer edge of the boat.

Although such linkages permit the desired positioning of the trolling motor unit, all such exposed linkages known to the inventor are exposed and are a source of accidents to the fisherman and other users of the watercraft. Further, trolling motors may be subject to reasonably severe environmental conditions because of weather and airborne dirt and other foreign matter. The exposed linkages of course require careful attention to ensure proper and convenient operation. If the linkage becomes fouled with foreign matter, the operation becomes more difficult and further introduces a further hazardous condition. Further, in the propulsion position, the motor unit and linkage should be rigidly locked in place to maintain reliable control of the positioning of the watercraft. The present systems are exposed and complex and are not conveniently locked and released for alternate placement in the transport and depending position.

Thus although the prior art pivotal mount assemblies do generally provide the desired mounting and placement of the trolling motor unit, there are very distinct disadvantages from the standpoint of safety, reliability and maintenance.

SUMMARY OF THE PRESENT INVENTION

The present invention is directed to an improved reliable pivotal mount assembly for proper positioning of a trolling motor unit between a depending propulsion position and a raised transport position. Generally in accordance with the present invention, the trolling motor unit is secured to a pivotally mounted arm means which supports a gear drive mechanism or means including a drive gear member responsive to arm rotation and a driven gear member coupled to the trolling motor unit. The gear mechanism or means is operable to directly pivot the trolling motor unit between the depending position and the raised retracted transport position in response to pivoting of the support arm means. The inventor has found that the gear drive means for positioning of the trolling motor unit provides a very reliable and practical method of positioning of the trolling motor. In a preferred and novel embodiment, the arm is constructed as an enclosing housing with the gear means mounted in protective relation within the housing and only partially exposed at the coupling to the motor unit.

More particularly in accordance with a preferred and practical embodiment of the present invention including a plurality of unique features and constructions, the pivotal mount assembly includes a mounting bracket for attachment to the deck. The mount assembly has a housing arm pivotally mounted at one end to the inner end of the bracket for positioning through one-hundred and 180° including extending inwardly of the boat in the transport position and outwardly to about the outer edge of the boat in the propulsion position. The arm is a generally closed tubular housing within which the gear mechanism is located. A fixed bevel gear is secured on the pivot axis of the inner arm end. A transfer shaft or torque tube is rotatably journaled within the housing and includes a gear coupled to the fixed bevel gear such that pivoting of the arm results in the rotation of the shaft bevel gear on the fixed gear. The opposite end of the shaft terminates within the housing with a drive bevel gear secured thereto. A coupling head is pivotally mounted in the outer end of the arm and includes a driven bevel gear sector mating with the drive bevel gear such that the rotation of the shaft positively positions the head. The head includes a swivel support means within which the trolling motor unit is rotatably mounted, preferably with a releasable means to permit the vertical adjustment of the depending extent of the trolling motor unit. By proper orientation of the bevel gears, the coupling head and motor unit are located between the depending propulsion position and the transport position in response to and in accordance with the 180° rotation and movement of the pivot arm.

The outer end of the torque tube and adjacent portion of the bevel gear sector preferably include a releasable pin and slot coupling elements as disclosed in the copending application of Friedel et al., entitled "PIVOTAL SUPPORT LOCK APPARATUS FOR TROLLING MOTOR APPARATUS", Ser. No. 610,302 filed Sept. 4, 1975, such that retraction of the torque tube releases the gear mechanism. In the extended propulsion position, the coupling elements are aligned and engage to positively prevent rotation of the head gear sector and thereby lock the trolling motor unit in the depending position relative to the pivot arm. In addition, the torque tube intermediate its length carries an arm locking element such as an eyelet or loop element, forming a part of a two piece latch or locking means, the opposite element such as a hook lever, of which is affixed to the mounting bracket. The arm locking means is constructed with the elements disengaged in response to the retraction of the torque tube to release the gear arm. The lever is provided with a camming means to reset to the lock position in response to placing the arm in the propulsion position.

In the preferred embodiment, the drive positioning of the assembly is essentially totally enclosed and thereby minimized the danger of fouling of the mechanism with foreign matter which can interfere with the desired operation of the mechanism.

The inventor has found that the gear drive means, particularly with the enclosure housing means provides a highly improved and practical pivotal mount assembly for the safe, reliable and convenient mounting of the trolling motor, as well as its manufacture. The structure of the invention can be manufactured as a rigid, long life assembly which is conveniently and safely operable by the boater or fisherman.

BRIEF DESCRIPTION OF THE DRAWINGS

The drawings furnished herewith illustrate the best mode presently contemplated by the inventor for carrying out the subject invention in which the above advantages and features are clearly disclosed as well as others which will be readily understood from the following description of the embodiments shown.

In the drawings:

FIG. 1 is a side elevational view of a trolling motor apparatus constructed in accordance with the teaching of the present invention and located or positioned in the boat propulsion position;

FIG. 2 is a fragmentary view similar to FIG. 1 showing the apparatus of FIG. 1 in the transport position;

FIG. 7 is a vertical section taken generally on line 7—7 of FIG. 4; and

FIG. 8 is a vertical section taken generally on line 8—8 of FIG. 4.

DESCRIPTION OF ILLUSTRATED EMBODIMENT

Figures 3, 4, 5, 6:
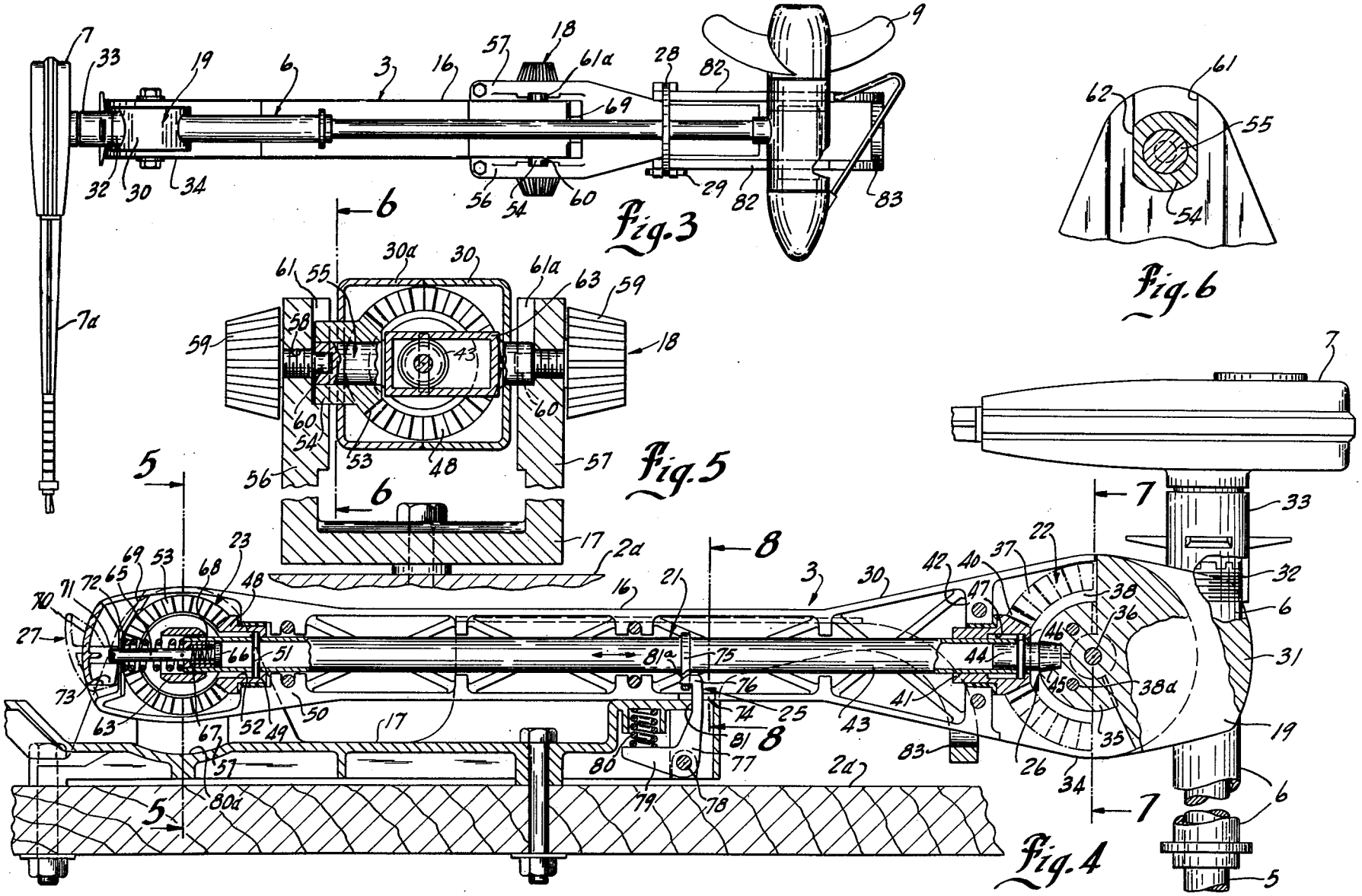
FIG. 3 is a top elevational view of the trolling motor apparatus.
FIG. 4 is a vertical section through the pivot arm shown in FIGS. 1–3.
FIG. 5 is a vertical section taken generally on line 5—5 of FIG. 4.
FIG. 6 is a fragmentary sectional view taken generally on line 6—6 of FIG. 5.

Referring to the drawings and particularly to FIGS. 1 and 2, the present invention is directed to the construction of a trolling motor unit 1 which is attached to watercraft or boat 2 and particularly to a forward horizontal deck 2*a*. The trolling motor unit 1 is secured to the deck 2*a* by a suitable pivotable mount assembly 3 for selective positioning of the trolling motor unit 1 between the depending propulsion position shown in FIG. 1 and a raised transport position shown in FIG. 2 wherein the trolling motor rests on the deck and generally within the confines or the outermost edge of the watercraft 2. Thus, the trolling motor unit 1 is uniquely adapted for application to bass fishing and the like where an accurate manueverability at very low speeds is desired. In such systems however, the watercraft 2 will generally be provided with a completely alternative high speed drive such as an outboard motor, not shown, for propelling of the watercraft to the fishing location.

The trolling motor unit may be of any suitable construction and it is only generally described herein. The present invention is particularly directed to the pivotal mount assembly 3 and the interconnection to the trolling motor 1 for positioning between the positions of FIGS. 1 and 2.

Generally, the trolling motor unit 1 includes a lower unit 4 secured to the lower end of a tubular support 5 in the form of a smooth pipe member. The pipe member 5, in turn, is rotatably mounted within a swivel tube 6 the upper end of which terminates in a head 7 having a handle 7*a* projecting therefrom. The lower unit 4 houses a suitable electric motor 8 which is coupled to rotate a propeller 9 secured to the aft end of the lower unit 4 in accordance with conventional practice. The electric motor 8 energization level is controlled to vary the speed of the propeller 9. Thus, suitable power leads 10 are shown extended from the motor 8 and a control circuit, not shown, which may also be located within the unit 4 through the pipe member 5, head 7, and handle 7*a* for interconnection to a suitable power supply such as a battery 11 in series with a suitable variable current control unit 12. Generally, the control unit 12 will be a foot operated device to allow the fisherman to control the speed of the propulsion without interferring with casting and the like.

In addition and in accordance with conventional practice, trolling motor unit 1 is rotated within the swivel unit 6 for turning the lower unit and thus steering of the boat 2. In the illustrated embodiment of the invention, a suitable linear to rotational conversion unit 13 is housed within the upper head 7 and coupled to the uppermost end of the conduit 5. The unit 13 is connected by a push-pull cable 14 to a suitable foot control 15 provided within the boat.

The trolling motor unit 1 including the lower unit 4 and interconnecting steering and speed controls may of course be of any suitable construction and consequently no further description thereof is given other than in connection with and for purposes of fully explaining the illustrated pivotal mount assembly 3 forming a preferred novel embodiment of the present invention.

Thus referring particularly to FIGS. 1 through 4, the pivotal mount assembly 3 generally includes a pivot support member or arm 16 which is pivotally interconnected at one end to a mounting bracket 17 by a pivot assembly 18. The opposite or outer end of the arm 16 includes a head 19 attached to the swivel tube 6 and pivotally interconnected by a pivot assembly or means 20 at the outer end of the arm 16. The arm 16 as more fully developed hereinafter defines a tubular housing within which a gear train positioning means 21 is housed and includes a positioning gear means 22 for selectively positioning of the head 19 and the interconnected trolling motor unit 1 and in response to the pivoting of the arm 16 through 180° and particularly between the propulsion position of FIG. 1 and the transport position of FIG. 2. Thus, the gear means 22 is activated automatically by the pivoting of the arm through a drive gear means 23 housed in the fixed pivotally mounted end of the arm 16 with a preferred and novel construction of such a system shown in FIGS. 4–8. In the transport position the arm 16 extends forwardly over and from the bracket 17 with the intermediate portion thereof resting within a U-shaped saddle support 24 integrally formed to the upper side of the mounting bracket 17. In the raised transport position of FIG. 2, the head end of the trolling motor unit is supported resting on the deck and the lower unit 4 rests on the upper wall of the bracket 24. Further, in the depending position of FIGS. 1 and 4, the pivot mount assembly 3 is locked to the deck and the trolling motor unit 1 is locked in such depending position. In the illustrated embodiment of the invention, an arm locking means 25 releasably locks the arm to the bracket 17 to prevent pivoting of the arm from the extended dependent support position. In addition, a gear locking means 26 is provided at gear means 22 to positively interlock and prevent rotation and loading of the gear means 21 with the trolling motor in the propulsion position. A common release means 27 is provided at the pivotally mounted inner end of the arm 16 and interconnected to simultaneously release the locking means 25 and 26 as more fully developed hereinafter.

In the transport position of FIG. 2, the arm 16 mechanism is not interlocked. A tie-down strap 28 is provided to secure the unit 1 to the bracket 17. The strap 28 may be of a resilient rubber-like strap with one end fixed to one side of the saddle 24 and adapted to loop over the trolling motor pipe 5. The opposite end is releasably interconnected to the opposite side of saddle 24 to hold the trolling motor in transport position. As shown in FIG. 2 the releasable end has a latch loop 29 adapted to fit over an enlargement on the side wall of the saddle 24.

Thus, the arm 16 is adapted to be pivoted between the position of FIGS. 1 and 2 with the gear means 21–23 selectively and automatically pivoting head 19 and attached trolling motor unit 1 relative to the arm 16 to positively establish the depending propulsion position and the horizontal transport position where it is located immediately adjacent the deck 2*a* and generally within the boat 2.

More particularly, in the illustrated embodiment of the invention arm 16 is shown as a two-piece housing member having similar housing members 30 and 30*a* which are interconnected by suitable bolt means to essentially enclose the gear positioning means 21. The support head 19 is shown as a solid cast member projecting inwardly between a bifurcated end of the arm 16. The head 19 includes a tubular opening 31 through which the swivel tube 6 extends. The head 19 further includes a threaded tubular extension 32 projecting upwardly from the opening with the swivel tube 6 passing therethrough. A locking nut 33 encircles the swivel tube 6 and is releasably threaded onto the tube 32 causing the outer end, which has end slits, to collapse into clamping engagement about the swivel tube 6 and thereby selectively locking the swivel tube 6 within the head 19. This provides for selective dependent positioning of the pipe 5 and thus of the lower unit 4 with respect to the watercraft 2 for adjusting the depth of the lower unit 4 within the body of water, not shown.

The head 19 includes an inwardly projecting portion located between the side arms 34 of the bifurcated end of the arm 16. The arms 34 are formed by integral extension of the side and top wall of the housing sections 30 and 30*a*. The upper walls are partially removed with an integral hub 35 of the head 19 projecting between the arms 34 and pivotally mounted therebetween by the pivot means 20. Thus, hub 35 is rotatably journaled on a bolt and bushing 26, which extends through the arms 34 and threads into a threaded opening in the one arm to firmly and rotatably mount the head between arms 34.

The head 19 further includes an integrally cast gear sector 37 which may be integrally cast with or otherwise connected to one side of the hub 35 and with the outer face thereof bearing on an adjacent portion of the one side arm 34. The gear sector 37 is shown as a semicircular bevel gear member with a mounting flange 38 encircling a reduced portion of the hub and secured by bolts 38*a* to the hub portion 35. The inner faces of the side arms are shaped to define inwardly projected cone-shaped portions 39 defining bearing surfaces against which the hub member abuts.

The bevel gear means 37 forms a part of gear means 22 and meshes with a bevel gear 40 which has a hub portion 41 rotatably mounted in a wall 42 of the arm 16 and in particular the housing sections 30 and 30*a*. The opening in the two-piece wall 42 is shown provided with a suitable radial and thrust bearing member for rotatably supporting of the bevel gear 40 in driving meshing engagement with the gear sector 37.

The bevel gear 40 is slidably interlocked with a torque tube 43 of gear train 21. Tube 43 extends rearwardly through the arm 16 and is interconnected at the opposite end to the gear means 23.

In the illustrated embodiment of the invention, the gear-tube interlock includes a locking pin 44 of locking means 26 which is secured within the corresponding end of the torque tube 43 and projects outwardly towards the hub 35. In the depending propulsion position, pin 44 is aligned with and moves into engagement with a locking opening or recess 45 in the periphery of hub 35 to the full line position shown in FIG. 4. A pin member 46 extends through the interlock pin 44 and the outer end of the torque tube 43 and extends outwardly therefrom into coupling slots 47 within the bevel gear 40 to the opposite side of the torque tube 43. Thus the pin 46 drivingly interconnects the torque tube 43 to the bevel gear 40 such that rotation of the torque tube 43 is directly transmitted to the bevel gear 40 and therefrom to the gear sector 37 of head 19. The torque tube 43, as more fully developed hereinafter, is slidably mounted within the housing 16 and must be withdrawn to disengage the pin 44 from the hub locking recess 45 to permit the rotation of the trolling motor unit 1 as the arm 16 pivots. The interlocking pin and slot type connection provides a simple connecting means to permit engagement and disengagement of the locking means 26 while maintaining the driving engagement between the bevel gear 37 and 40.

The torque tube 43 is driven by the gear means 23 which includes a bevel gear 48 having a hub portion 49 rotatably mounted in a rear wall 50 of the arm 16 similar to the mounting of the bevel gear 40. The torque tube 43 is coupled to the bevel gear 48 by a diametrically extended coupling pin 51 mating with coupling slots 52 in the bevel gear 48 in the same manner as the coupling of the bevel gear 40. This permits the sliding movement of the torque tube 43 as previously described.

The bevel gear 48 meshes with a bevel gear 53 fixed to mounting base 17 and pivots with arm 16 as follows: (FIG. 5)

The bevel gear 53 includes a hub 54 journaled on a shaft 55 forming part of pivot support 18. The shaft 55 extends through the housing sections 30 and 30*a* and outwardly thereof into a pair of lateral arms 56 and 57 which project upwardly integrally from and as a part of bracket 17. The arms 56 and 57 include threaded openings 58 coaxial of the location of shaft 55 to receive similar clamping bolts 59 which have relatively large heads for manual operation. The inner end of the bolt members 59 include smooth pivot pins 60 extending inwardly into corresponding recesses in the ends of the shaft 55, such that the shaft 55 is free to pivot on the pins.

The hub 54 of gear 53 projects outwardly with the shaft 55 into recess 61 in the bracket arm 56. At the opposite side the shaft 55 extends outwardly directly into a smaller recess 61*a*. The sides of the hub 54 are formed as flat surfaces 62 to provide interlocking with the flat sidewalls of the recess 61, as most clearly shown in FIG. 6. The bevel gear 53 is thus locked against rotation with the arm 56 and bevel gear 53 is locked against rotation. The shaft 55 however, is pivotally mounted within the hub 54 and within the slot 61*a* in the opposite arm 57 and thus is free to rotate.

In the illustrated embodiment of the invention, the shaft 55 includes an intermediate box section 63 immediately adjacent the inner face of the bevel gear 53 and defining an opening into which the torque tube 43 projects from the bevel gear 48, as shown in FIG. 4. The release mechanism 27 extends through the box section 63 and is interconnected to the adjacent end of the torque tube 43 for selective positioning thereof.

Thus with the bevel gear 53 locked against rotation, pivoting of the arm 16 results in the bevel gear 48 rolling across the fixed gear 53 and imparting rotation to gear 48 and correspondingly to torque tube 43. This rotation is transmitted through the opposite bevel gear 40 to the sector gear 37 with a corresponding positive rotation of the gear sector 37. The integrated head 19 is thereby also pivotal positioned along with the interconnected swivel tube 6 and therefore the interconnected trolling motor unit 1.

As previously noted, the transmission of the forces is positively prevented by the gear interlock means 26 with the unit in depending position, and must be released before pivoting of the arm to the transport position. The release means 27 is coupled to the torque tube 43 to permit retraction and release of the means 26 and simultaneously of the arm interlock means 25, as follows.

The release means 27 includes a rod 65 extending into the torque tube with an inner head 66. The end of the tube is closed by a generally cup-shaped member 67 with the rod 65 extended through the base. A small coil spring 68 within the cup-shaped member 67 acts between the base thereof and the head 66 to continuously urge the rod 65 inwardly into the torque tube 43. The outer end of the rod 65 projects through arm 16 and outwardly through the end or back wall 69 of the housing arm 61 with a latch release handle 70 connected thereto as by a pin 71.

A relatively heavy coil spring 72 encircles the rod 65 between the interior of end wall and the adjacent end of the torque tube 43 and cup 67 and continuously urges the torque tube 43 forwardly to establish the locked position of gear lock means 26. The latch release handle 70 is located within a pocket formed within the housing arm 16 by an inset portion of the back wall 69. The handle 70 is generally a plate-like member with a relatively thick solid portion which is recessed and pinned to the rod 65 to define a pivot axis generally parallel to the pivot axis of the pivot means 18. The opposite end of the handle 70 thus is spaced from the inset wall 69 for convenient finger grasping and pivoting of the handle 70 on the pinned attachment 71. The opposite solid end portion of the handle 70 defines a cam wall 73. Thus, when handle 70 is pivoted, the cam wall 73 moves into engagement with the recessed end wall 69, providing a camming action, drawing the rod 65 outwardly and thereby moving the head 66 into engagement with the cupmember and exerting a retraction force on the torque tube 43. With the handle 70 pivoted to the release position the locking or return force exerted by the spring 72 on rod 65 holds the cam end or wall 73 into bearing engagement with the end wall 69 of the recess and locks the release means 27 in the release position. The movement of the handle 70 from the locked position to the release position, establishes sufficient movement of the torque tube 43 to completely withdraw the pin 44 from the recess 45 and thereby release the gear lock means 26.

The release movement of the torque tube 43 to the release position simultaneously releases the arm lock means 25.

In the illustrated embodiment of the invention, the arm lock means 25 includes a hook- and eye-type interlock means including a loop element 75 secured to the torque tube 43 with a downwardly extended portion defining a locking opening or eye member with the arm 16. The bottom wall of arm 16 has an opening 74 aligned with the loop element 75 to receive a hook end 76 of a latch lever 77 which is pivotally mounted to the base portion of the bracket 17. In the locking position, the loop element 75 engages the hook end 76 of latch lever 77. The lever 77 is generally an L-shaped member having the hook end 76 on one arm and a spring loaded arm 79 extending beneath an upper wall of the bracket 17. A coil spring 80 urges the latch lever 77 to the latch position, as shown in FIG. 4.

When the torque tube 43 is retracted the loop element 75 is moved from the hook end 76, thereby releasing the arm 16 for pivotal rotation about the pivot means 20, as previously described.

The actual pivoting of the arm 16 with the release mechanism 27 latched in the release position causes the extended handle 70 to move into engagement with the bottom wall of the bracket 17. This positively pivots the handle 70, in a clockwise direction as viewed in FIG. 4, to return the handle to the release position. The bottom bracket includes a concave or curved portion 80*a* aligned with the support arm 56 and 57 which complements the outer surface of the end of arm 16 with handle 70 pivoted to the lock position.

By the time arm 16 has pivoted sufficiently for the handle 70 to engage the bracket 17, the hub 35 of the head 19 has been rotated by the gear train 21 to align its outer periphery with the retracted end of the pin 44. Consequently, when the handle 70 is released, the hub 35 holds the torque tube 43 in the retracted position. The inner small spring 68, however, will function to pull the rod 65 into the torque tube 43 and permit and in fact assist the return of the handle 70 to the reset position.

Thus, with motor unit 1 in the depending propulsion position, the gear system or train 21 is locked against possible movement and the arm 16 is positively held against pivotal rotation. It is significant with the gear drive system, that such drive system is released with the arm release means 25. This positively avoids the establishing of excessive forces on the gear teeth which might occur if the arm lock means 25 were released without a released gear system.

When the arm 16 is again pivoted to the propulsion position the recess 45 will again automatically align with the end of pin 44 allowing the torque tube under the action of spring 72 to extend or move laterally to engage the gear lock means 26 and simultaneously the arm lock means 25.

Further, bracket 17 has a stop edge 81 portion limiting the pivoting of the latch lever 77 upon retraction of the loop 75 within the access opening 74 and further holding the hook member 76 in alignment with the lower end of the loop 75 of the dropping arm 16. Further, the outer end of the hook 76 is provided with an upper inclined cam wall 81*a*. When arm 16 moves downwardly, the hook end 75 will move through the opening 74 in the lower wall of the arm 16 and into engagement with the inclined cam wall 81*a* on the end of the hook 76. The arm 16 will have sufficient force to pivot the lever 77 about its axis, compressing the spring 80, and moving the latch hook 76 to the right and allowing loop 75 to move down the end of the hook 76. The spring then of course returns, the lever to the latch position, as shown in FIG. 4.

In addition in the transport position, the motor is preferably laid to one side with the elongated head 7 extending laterally across the boat and with the lower unit 4 similarly oriented upon the upper wall of the U-shaped saddle 24. The handle on the upper head 7 permits rotation of the swivel 6 within the head 19 to the desired transport position. Although, the friction clamp which supports the trolling motor unit 1 in the desired vertical position bars allow forced rotation of the head to a transport position when required. Further, where a flexible handle is employed such as disclosed in the copending application of Owen C. Russell entitled "OPERATING HANDLE FOR PIVOTALLY MOUNTED TROLLING MOTOR" Ser. No. 610,308 filed Sept. 4, 1975. Even if the motor is not rotated, the handle can readily flex to accomodate the positioning in a vertical position.

The support pipe 5 is relatively freely pivotally mounted within the swivel tube 6. With the foot control released, the lower unit 4 can therefore readily turn with the pipe 5 within the swivel tube 6. In the illustrated embodiment of the invention the saddle 24 is generally a U-shaped member having upstanding sidewalls 82 which in the transport position are located to the opposite sides of the arm 16. The sidewalls 82 include a forward curved end 83 along which the lower unit is guided to and from the depending position.

The present invention thus provides a rugged, reliable position operating mechanism for outboard trolling motors with protective means to provide a long operating life and to minimize hazards to the user. Further, the mechanism is protected against accidental damage.

Thus, the hold down or locking mechanism must positively be released to lift the mechanism to the transport position and is automatically reset in response to the pivoting of the trolling motor unit 1 to its propulsion position. Further, the gear system provides a very positive positioning of the trolling motor unit between the desired positions while maintaining essentially a total enclosure of the locking and positioning mechanism. The arm 16 protects the gear train and locking mechanism from adverse environmental conditions in which the trolling motor may be employed and significantly reduces creation of any hazardous condition to the user as a result of exposed linkages and the like.

The present invention thus provides an improved practical trolling motor pivot mount assembly which can be conveniently manufactured and used.

Various modes of carrying out the invention are contemplated as being within the scope of the following claims, particularly pointing out and distinctly claiming the subject matter which is regarded as the invention.

I claim:

1. In an electric trolling motor apparatus having an electric trolling motor for propulsion of a watercraft, a mounting bracket means adapted to be secured to the watercraft and having a pivotally mounted arm means, a gear train means mounted on said arm means and having a control gear means coupled to said mounting bracket means and a driven gear means rigidly connected to the control gear means by a gear and shaft means, a motor support means connected to said driven gear means, said gear train means establishing rotation of the motor support means and said electric trolling motor in response to the pivoting of the arm means between a lowered propulsion position and a raised transport position.

2. The electric trolling motor apparatus of claim 1 wherein said arm is a hollow housing member and said gear train means is located within said housing member and said housing defining an essentially complete protective enclosure of the gear train means.

3. The apparatus of claim 1 wherein said motor support means includes a swivel head means pivotally secured to said arm means and movable between essentially perpendicular positions defining a vertical propulsion position and a horizontal transport position, said driven gear means being secured to the head means, and a swivel means connected to the trolling motor and mounted within said swivel head means.

4. In the apparatus of claim 3 wherein said arm means is a hollow housing member and said gear train means is located within said housing member and said housing defining an essentially complete protective enclosure of the gear train means.

5. In the electric trolling motor apparatus of claim 1 wherein said arm means includes an elongated housing, said gear train means being located within said arm and including an elongated shaft means having coupling bevel gears secured to the opposite ends of the shaft means, and said control gear means and said driven gear means being bevel gears, said coupling bevel gears meshing with said control gear and said driven gear, said driven gear being affixed to said motor support means.

6. In the apparatus of claim 5 wherein said motor support means includes a head member, said driven bevel gear being affixed to the side of the head member, and means pivotally mounting of the head member within the outer end of the arm means to enclose said driven bevel gear.

7. An electric trolling motor apparatus for propulsion of a watercraft, comprising a mounting bracket adapted to be secured to the watercraft, an arm means pivotally secured to the inner end of said mounting bracket and pivotal between extended positions extending in opposite directions from the pivot connection, a motor support means pivotally mounted within the outer end of said arm and having means to receive an electric motor unit, a gear train means mounted within said arm and having a fixed gear means and a driven gear means coupled through a rigid intermediate gear and shaft means and establishing rotation of the driven gear means in response to pivoting of the arm between said extended positions.

8. The trolling motor apparatus of claim 7 wherein said motor support means includes a head element pivotally mounted within the outer end of said arm, said driven gear means being a head bevel gear fixed to the side of the head element with the gear axis aligned with the pivot axis of the head element, said intermediate gear and shaft means including a drive gear rotatably mounted within the arm in meshing engagement with said head bevel gear and coupled by said intermediate gear and shaft means to said fixed gear means.

9. In the electric trolling motor apparatus of claim 7 wherein said arm is a generally tubular housing, said fixed gear means includes a fixed gear coaxially mounted with the pivot axis of the arm means to the mounting bracket, said intermediate gear and shaft means having a first transfer gear meshing with the fixed gear, a transmission shaft means rotatably supported in the arm and connected to said transfer gear and terminating in the outer end of the arm, and a second transfer gear secured to said outer end of said shaft, said driven gear means including a driven gear connected to said motor support means and pivotally mounted in mesh with said second transfer gear.

10. The trolling motor apparatus of claim 9 wherein said bracket includes a U-shaped support portion on the inner end, said arm being located in said support portion, a pivot shaft means connected to the support portion and to the arm to pivotally mount the arm, said fixed gear being a bevel gear having a hub mounted on said shaft and fixed to said support portion.

11. An electric trolling motor apparatus, comprising a mounting bracket adapted to be releasably secured to a boat and having a pivot support lug means, a hollow arm having a pivot shaft means pivotally secured at one end to the lug means of the bracket and having an opposite bifurcated end with an inner end wall, a motor support tube, a pivot head having a pivot hub with a gear sector affixed to one end face and being located within the bifurcated end, said gear sector projecting inwardly of the hub and having inwardly facing teeth, a first transfer bevel gear rotatably mounted in the inner end wall in mesh with said gear sector, a fixed bevel gear rotatably mounted on said pivot shaft means within said arm, a second transfer bevel gear rotatably mounted within said arm in mesh with said fixed bevel gear, a torque tube rotatably and slidably journaled within said arm, said torque tube extending through said first and second transfer bevel gears and being coupled thereto by an axial slot and pin connection, said hub having a periphery aligned with the torque tube, a gear lock means including a slot and pin connected one each to the end of the torque tube and the aligned hub, and a resilient means within the pivoted end of the arm and connected to continuously urge the torque tube outwardly to engage said gear lock means.

* * * * *

UNITED STATES PATENT AND TRADEMARK OFFICE

CERTIFICATE OF CORRECTION

PATENT NO. : 4,008,680

DATED : February 22, 1977

INVENTOR(S) : Charles F. Alexander, Jr.

It is certified that error appears in the above-identified patent and that said Letters Patent are hereby corrected as shown below:

Column 2, Line 31, after "and" cancel "180°" and insert---eighty degrees (180°)--.

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*